US005741085A

United States Patent [19]

Wirtgen

[11] Patent Number: 5,741,085

[45] Date of Patent: Apr. 21, 1998

[54] PROCESS AND APPARATUS FOR THE REPAIR OF DAMAGED ROADS

[76] Inventor: Reinhard Wirtgen, Hohner Strasse 2, D- 5469 Windhagen, Germany

[21] Appl. No.: 800,552

[22] Filed: Feb. 18, 1997

Related U.S. Application Data

[63] Continuation of Ser. No. 524,122, Aug. 25, 1995, abandoned, which is a continuation of Ser. No. 78,588, Jun. 17, 1993, abandoned.

[30] Foreign Application Priority Data

Nov. 8, 1992 [DE] Germany ..... 42 37 512.6

[51] Int. Cl.[6] ..... E01C 23/12

[52] U.S. Cl. ..... 404/75; 404/90; 404/91

[58] Field of Search ..... 404/72, 75, 76, 404/81, 90, 91, 92, 101, 104, 108, 111, 118; 299/10, 39

[56] References Cited

U.S. PATENT DOCUMENTS

| | | | |
|---|---|---|---|
| 4,124,325 | 11/1978 | Cutler | 404/90 X |
| 4,129,399 | 12/1978 | Ruge | 404/118 |
| 4,172,679 | 10/1979 | Wirtgen | 404/90 |
| 4,233,015 | 11/1980 | Teague et al. | 405/263 |
| 4,317,642 | 3/1982 | Wirtgen | 404/91 X |
| 4,335,974 | 6/1982 | Wirtgen | 404/91 X |
| 4,453,856 | 6/1984 | Chiostri et al. | 404/92 X |
| 4,473,320 | 9/1984 | Register | 404/91 |
| 4,682,909 | 7/1987 | Mihara | 404/91 X |
| 4,765,772 | 8/1988 | Benedetti et al. | 404/108 X |
| 4,871,283 | 10/1989 | Wright | 405/263 |
| 4,944,631 | 7/1990 | Egli | 404/91 |
| 4,971,476 | 11/1990 | Guillon | 404/91 |
| 5,000,615 | 3/1991 | Murray | 404/92 X |
| 5,026,206 | 6/1991 | O'Connor | 404/77 |
| 5,324,136 | 6/1994 | Reymonet et al. | 404/107 |

FOREIGN PATENT DOCUMENTS

| | | |
|---|---|---|
| 0158560 | 10/1985 | European Pat. Off. . |
| 0182748 | 5/1986 | European Pat. Off. . |
| 0237424 | 9/1987 | European Pat. Off. . |
| 0274920 | 7/1988 | European Pat. Off. . |
| 0316752 | 5/1989 | European Pat. Off. . |
| 993311 | 11/1951 | France . |
| 2562109 | 10/1985 | France . |
| 2586435 | 2/1987 | France . |
| 505767 | 4/1976 | U.S.S.R. . |
| 1668521 | 8/1991 | U.S.S.R. . |
| 1761850 | 9/1992 | U.S.S.R. . |

OTHER PUBLICATIONS

WO 85/04681 PCT International Publication, Published 24 Oct. 1985.

Servas, Vladis, "Cold Mix Recycling", Civil Engineering, vol. 839, Mar. 1981, London, Great Britain.

*Primary Examiner*—James Lisehora

*Attorney, Agent, or Firm*—Helfgott & Karas, P.C.

[57] ABSTRACT

In a process and an apparatus for the stabilization or repair of damaged roads, the road surface is milled off and the material is crushed on the site. The surface material so obtained is added with binders of cement, cement sludge, water and/or bitumen emulsion and/or pre-mixed addition material and/or mineral components of the required grain size and amount, and the material so prepared is again built into the road surface.

13 Claims, 3 Drawing Sheets

PROCESS AND APPARATUS FOR THE REPAIR OF DAMAGED ROADS

This is a continuation, of application Ser. No. 08/524,122, filed Aug. 25, 1995, now abandoned, which itself was a continuation, of application Ser. No. 08/078,588, filed Jun. 17, 1993, now abandoned.

BACKGROUND OF THE INVENTION

Constantly increasing traffic on highways and express ways necessitates continuous repair of the roads. The methods and equipment used for this purpose have changed in the course of the time and have been adapted to the growing needs.

While in former times, only the upper surface of the damaged roads was milled off and the milled-off material so obtained was dumped on waste deposits and layers of new material were applied, more consideration was lately given, with a view to growing environmental awareness, to the renewed use of the milled-off material. Methods were developed by which a complete re-use of the milled-off material is possible so that, on one hand, expensive building material is saved and, on the other, overloading of the waste deposits with such milled-away material is avoided.

In this recycling process, the processing of the milled-off material is made on the site so that the transportation of the milled-off material to a processing plant and the return to the building site is avoided.

In the so-called cold recycling process, the road surface is milled away to the required depth up to about 40 centimeters and is crushed, is intensively blended with a binder consisting of cement or cement sludge and/or bitumen emulsion and is newly built in. Frequently, a cover layer of new asphalt is applied as the upper cover.

Such cold recycling processes have reduced the costs for the repair of damaged asphalt layers quite considerably. Such cold recycling processes, however, have the disadvantage that the composition of the milled-off road surface material cannot be changed, or with difficulties only, as concerns the grain size of the mineral materials. Roads repaired mainly by this process, however, are characterized in that the composition of the asphalt layers, particularly the lower bearing layers, varies very frequently so that the milled-off material does no longer meet modern requirements as concerns grain composition.

Preceding spraying of hydraulic binder on the road surface by means of a spraying vehicle, furtheron, as used in this process, has proved to be problematic since it is blown away in windy weather. This means that an exact continuous addition is not safeguarded and the environment is strongly affected.

A further disadvantage of the cold recycling process hitherto employed, is the small operation width of the devices by which a processing of the whole width of a road lane is not possible; connecting seams of the recycled layer occurring in the area of the individual lanes prove to constitute a problem.

SUMMARY OF THE INVENTION

Starting from this state of the art, it is an object of the present invention to provide a process and an apparatus by which the road surface is milled away to the necessary depth and the material is crushed, on the one hand, and, at the same time, the possibility is provided to add, on the site, i.e. in the recycling machine, mineral materials of the required grain size and/or binders such as cement or cement sludge and/or bitumen emulsion in an amount required.

In accordance with the invention, the problem is solved by a process of the kind defined in the beginning for the repair of damaged roads by making renewed use of the milled-off material, adding binders and building-in of the new layer, which is characterized in that the milling-off of the damaged road surface is performed over the whole width of the road lane at a depth up to about 40 centimeters, the material is crushed, is blended on the milling machine with mineral component(s) of the required grain size and amount or with pre-mixed aggregates and binder(s) consisting of cement or cement sludge, water and/or bitumen emulsion, and is then built in again.

It has shown to be useful if the hydraulic binder, such as for instance cement is chargewisely pre-blended in a container and is injected during the working process.

The mineral constituents are added via conveyor belt or worm conveyors which are controlled as a function of the feeding speed of the recycling machine. The liquid binders are added via corresponding dosing pumps, and the cement which per se is a powder and which was hitherto sprayed onto the road surface to be repaired by a spraying vehicle, is suitably added as a cement sludge (suspension).

With a view to the variable operation width making the processing of the whole width of a road lane possible, the material to be recycled is homogeneously blended with the aggregates and safeguards a uniform material consistency over the whole width. By the addition of mineral aggregates, furtheron, the evenness of the road can be improved.

In the process according to the invention, all the components required for the repair of the road surface are provided on the recycling machine so that changes in the composition of the layers to be repaired can be levelled by corresponding control and/or regulation of the addition amounts of the component in question so that the new layer produced in this way fullfils the requirements of modern traffic.

In the process according to the invention, the composition of the road surface to be repaired is suitably found by sampling and analysis; the data so obtained are inputted in a computer which, depending on the inputted desired values, determines the materials to be added, in the respective amounts required, and at the same time defines the addition of mineral constituents and binders transferring this to the corresponding control and regulating means for corresponding control and regulation.

In the process according to the invention, therefore, a reprocessed material is obtained which shows optimum composition and hence fully corresponds, in the built-in state, to all the requirements of modern road traffic.

The apparatus for performing the process according to the invention comprises an automotive chassis having motor-driven milling roller(s) disposed under it and a compacting unit both being variable in the operational width. It is characterized in that storage containers including dosing means for the mineral component(s), or the added mixed material, end the binder component(s) and mixing means for the milled-off material end the aggregates are provided on the chassis.

In accordance with a further advantageous embodiment, the apparatus for performing the process includes storage containers for the hydraulic binders and for the bitumen emulsion and the water. In this case, the hydraulic binder is continuously mixed with the water and/or the bitumen emulsion in the required composition and is injected, depending on the feed speed, into the mixer space by means of a dosing pump.

As the mixing device, any mixer such as for instance power mixers can be used. It has however shown to be of particular advantage to use the milling roller itself as the mixing means and/or to employ it in combination with a mixer for the components to be blended. To this end, the mineral components, on one hand, and the binder component(s), on the other, are fed into the space of the milling roller suitably closed by a front cover plate and a rear stripping plate, and are intimately mixed. Via an outlet opening in the rear stripping plate, the material leaves the milling roller space and, if necessary, is additionally fed to a mixer. The ready-mixed material is then received by the worm conveyor and is built-in in accordance with the profile and is compacted by the compacting unit.

The dosing means for the components provided on the recycling machine are preferably controlled or regulated, road dependently, considering the composition of the old road surface as determined by analysis. In this way, changes in the composition of the old road surface can immediately be levelled out on the recycling machine by changing the addition amounts.

In accordance with a particular embodiment of the apparatus according to the invention, a plurality of storage containers including dosing means for mineral components and additional mixing material as well as for water, bitumen emulsion and hydraulic binders are provided.

This makes it possible to fill the storage containers with mineral constituents while, on the other hand, in further containers, for instance pre-mixed additional mixing material and further aggregates are stored. In this way, it is possible to more exactly adapt the composition and the grain size composition of the material obtained when milling off the old layers to the required compositions and thus obtain a material for re-use which corresponds to all requirements of modern road traffic.

The cement component is premixed with the amount of water required for the recycling material to form a suspension. The bitumen emulsion component is added in the same way as the water by computer controlled and/or regulated feed pumps. In this case, the bitumen emulsion is blended with the cement suspension and is sprayed over the whole width of the milling roller into the milling roller space and/or the mixer. By so doing, the addition components are intimately blended with the milled-off material.

For dosing the mineral components and the additional mixing material, computer controlled and/or regulated conveyor belts or worm conveyors are provided, which transport the material from the storage containers provided on the machine into the milling roller space where it is intimately mixed with the milled-off material.

The control and/or regulation of the feed pumps and/or the conveyor belts, or the worm conveyors, respectively, is obtained, as already mentioned, via a computer in which the composition of the old road surface, road-dependently determined by analysis, is inputted and where, based on these data, the addition amounts are found and are added in the required amount.

The milling-off of the old road surface at a required depth of up to 40 centimenters over the whole width of a road lane requires an extraordinarily massive structure of the machine and relatively large power reserves of the drive engine. With a view to the high performance of the recycling machine, the consumption of aggregates is very high.

In accordance with a further advantageous embodiment of the present invention, only the dosing means including the control and/or regulation are disposed on the recycling machine while the addition components are stored in corresponding storage containers on a separate transportation vehicle and are connected, via conveyor means, to the dosing means of the recycling machine.

The transportation vehicle including the addition components disposed thereon travels suitably in front of and/or behind the recycling machine and delivers the addition components in the desired amounts directly to the dosing means.

This has the advantage that the weight of the recycling machine is not too excessive, and on the other hand, the addition components are available in larger amounts so that a larger productivity is obtained.

The required conveyor means for the liquid components are hoses having snap locks and for the mineral constituents are conveyor belts or worm conveyors where the drive, and hence the productivity, is also controlled, or regulated, respectively.

In accordance with a further advantageous embodiment, only the storage containers for the mineral components are disposed on the recycling machine while the storage containers for the liquid components remain on the transportation vehicle.

In summary, it results that the process according to the invention and the apparatus according to the invention provided for it lead to a substantial improvement of the so-called cold recycling process particularly in that differences in the reprocessed material of the old road surface can be levelled out in the recycling machine so that in case of a 100 percent re-use of the milled-off material, optimum compositions of the cold-recycled layers are obtained so that the road layers so repaired by the cold recycling process fullfil all the requirements of modern road traffic.

In the following, the invention is explained in more detail based on the attached drawings:

DETAILED DESCRIPTION OF THE PREFERRED EMBODIMENTS

Figure 1:
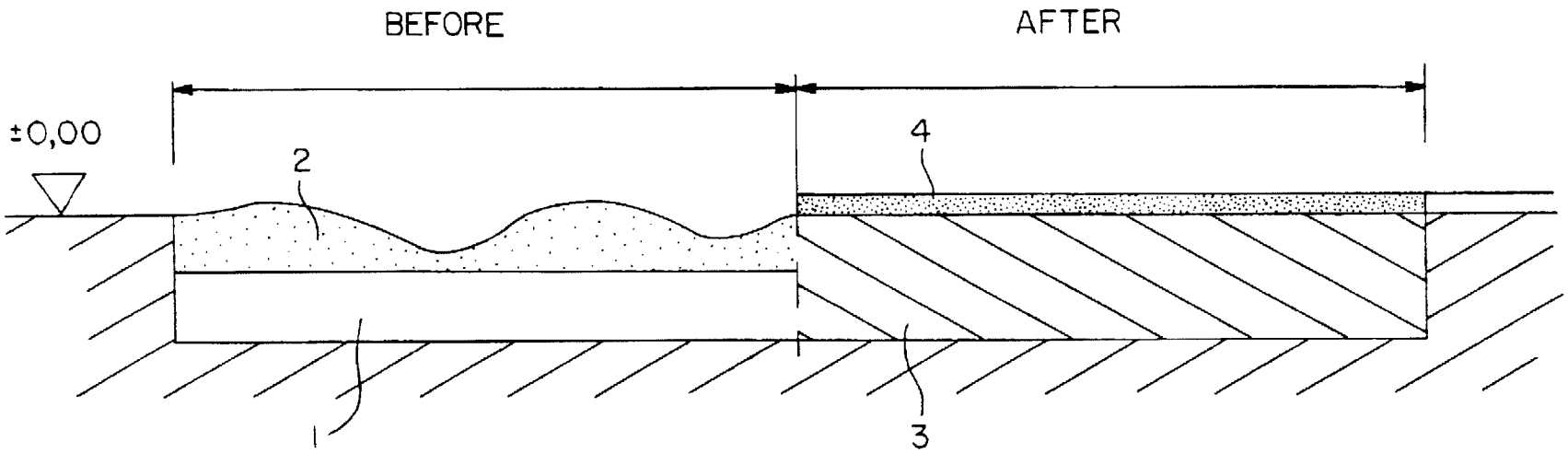
FIG. 1 shows the layer structure of a road surface before and after the cold recycling process.

In FIG. 1, the portion of the damaged road surface referred to as "Before" is shown in cross section. Onto gravel layer 1, bituminous layers 2 are applied, which are heavily grooved and have to be repaired.

Bituminous layers 2 and/or gravel layer 1 under it are milled off to the required depth up to 40 centimeters and are crushed in accordance with the process of the invention, are mixed with mineral components of the required grain size and amount or addition mixing material and/or with binder (s) consisting of cement, water and/or bitumen emulsion, and are built in to constitute cold-recycled layers 3, referred to as "After". If necessary, additional new wear-protection layer 4 of new layer material may be applied upon cold-recycled layers 3.

By sampling and analysis of the old road surface performed before the recycling process, the composition of it was exactly determined, and in accordance with this composition the addition component was added, depending on the road, in exactly dosed form and amount in order to provide a cold-recycled new road surface which, with a view to the cold-recycled layers, shows optimum composition and thus fullfils all the requirements of modern road traffic.

Figure 2:
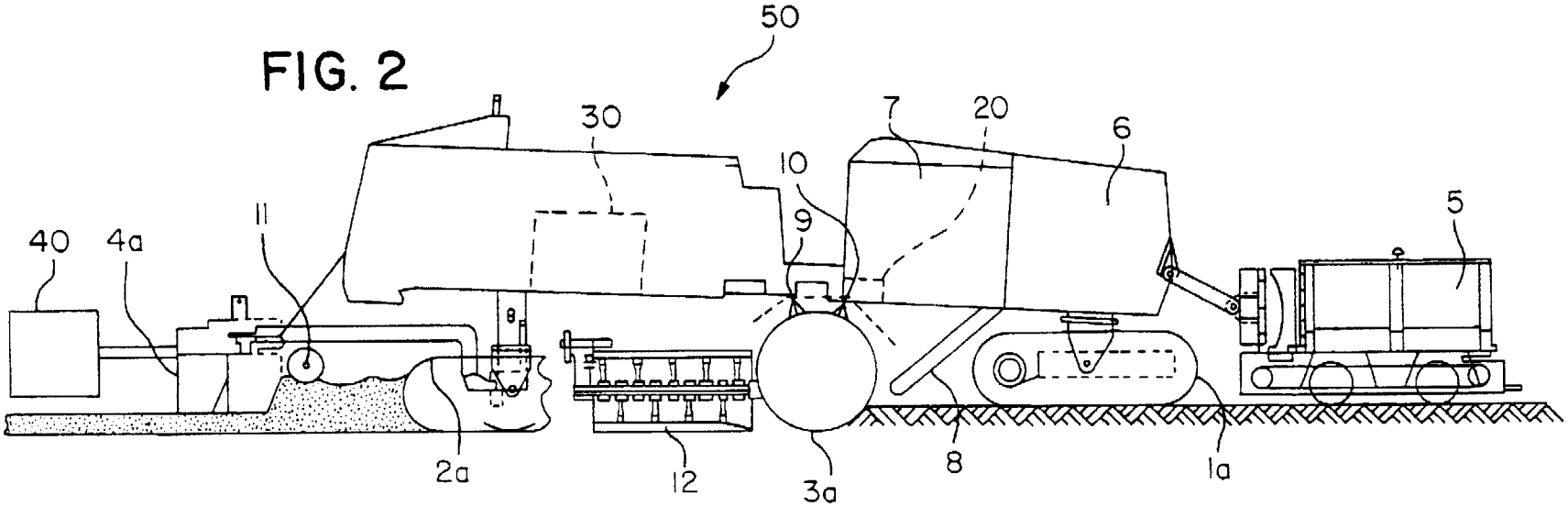
FIG. 2 shows a schematic lateral view of a cold recycling machine according to the invention.

FIG. 2 shows a schematic lateral view of an apparatus for performing the process according to the invention, comprising an automotive chassis on caterpillar tractors® 1*a*, 2*a* and a motor-driven milling roller 3*a* is disposed under it. A compacting unit 4*a* where the storage container including dosing means for mineral component(s) 5 and for the binder components 6, 7 is provided.

A mixer 12 disposed behind the milling rollers 3*a* in combination with the milling roller serves for the intimate mixing of the milled-off material.

The mineral components 5 are available in several different compositions in a container subdivided into sections in the longitudinal direction, as shown, and are fed to the milling roller space via transportation means 8. Jets 9 and 10 by which the cement suspension and/or the bitumen emulsion is injected are also directed into this milling roller space and/or into the mixer 12.

The milled-off material so blended with mineral constituents and binders exits through an opening provided in the rear stripping plate of the milling roller space and can be transferred to a mixer from which it is distributed, by a worm distributor 11, over the width of the road where the material is compacted by compacting unit 4*a* to constitute the finished layer.

The cement component is premixed with the amount of water required for the recycling material to form a suspension which is applied as jet 9 into the milling roller space. The bitumen emulsion component is added in the same way as the water by computer controlled and/or regulated feed pumps 20 as jet 10. In this case, the bitumen emulsion jet 10 is blended with the cement suspension jet 9 and is sprayed over the whole width of the milling roller 3*a* into the milling roller space and/or the mixer 12. By so doing, the addition components are intimately blended with the milled-off material.

For dosing the mineral components and the additional mixing material, the transportation means 8 which may be computer controlled and/or regulated conveyor belts or worm conveyors are provided, which transport the material from the storage containers 6, 7 provided on the machine into the space of the milling roller 3*a* where it is intimately mixed with the milled-off material.

The control and/or regulation of the feed pumps and/or the conveyor belts, or the worm conveyors, respectively, are obtained, as already mentioned, via a computer 30 (FIG. 2) in which the composition of the old road surface, road-dependently determined by analysis, is inputted and where, based on these data, the addition amounts are found and are added in the required amount.

The milling-off of the old road surface at a required depth of up to 40 centimeters over the whole width of a road lane requires an extraordinarily massive structure of the machine and relatively large power reserves of the drive engine. With a view to the high performance of the recycling machine, the consumption of aggregates is very high.

Reference numeral 40 designates a transportation vehicle. The recycling apparatus or machine is denoted by numeral 50.

In accordance with an embodiment of the present invention, only the dosing means including the control and/or regulation are disposed on the recycling machine while the addition components are stored in corresponding storage containers on a separate transportation vehicle and are connected, via conveyor means, to the dosing means of the recycling machine.

The transportation vehicle 40 including the addition components disposed thereon travels suitably in front of and/or behind the recycling machine and delivers the addition components in the desired amounts directly to the dosing means.

The required conveyor means for the liquid components are hoses having snap locks and for the mineralic constituents are conveyor belts or worm conveyors where the drive, and hence the productivity, is also controlled, or regulated, respectively.

In accordance with another embodiment, only the storage containers for the mineral components are disposed on the recycling machine 50 while the storage containers for the liquid components remain on the transportation vehicle 40.

Figure 3:
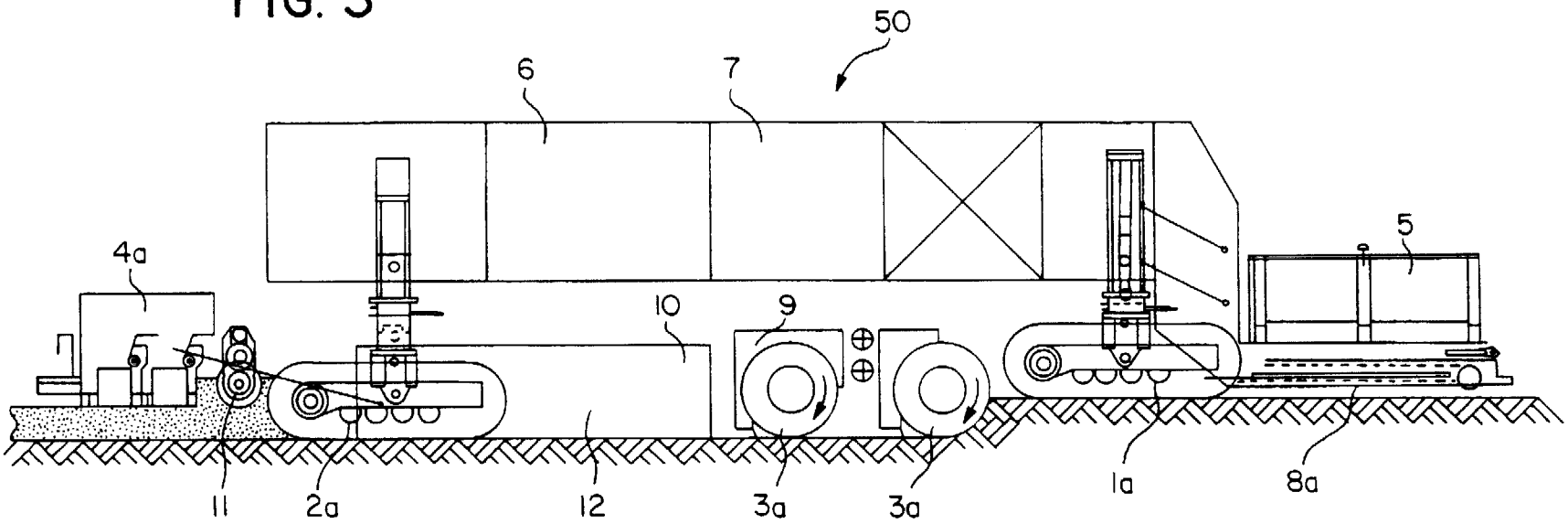
FIG. 3 shows a schematic lateral view of a different cold recycling machine according to the invention.

FIG. 3 shows a schematic lateral view of a different apparatus for performing the process according to the invention, also comprising an automotive chassis on caterpillars tractors® 1*a*, 2*a* and motor-driven milling rollers 3*a* disposed under it and variable in their operational width so that they can be adapted to the respective road width. Compacting unit, storage containers, dosing means for mineralic components 5 and for binder components 6, 7 correspond to the apparatus according to FIG. 2.

Instead of storage containers 5 through 7, provided on the front portion of the recycling machine, connecting pieces and dosing and control means only may be provided, according to a further embodiment of the present invention, at this location in order to receive the liquid binders, on one hand, and mineral component 5, on the other, from a transporting vehicle which travels before the machine. Smaller storage containers can of course be kept as buffer containers in order to keep up the recycling process even when the transportation vehicle is exchanged.

Transportation of the mineral components is performed in this case via a conveyor 8*a* belt, or a worm conveyor, respectively (FIG. 3), which, if desired, runs through a conveyor tube.

I claim:

1. An apparatus for the stabilization or repair of damaged roads by a cold-recycling process, wherein the damaged road surface is milled off over the whole width of a road lane at a depth up to about 40 centimeters and the milled-off material is crushed, a sample of the crushed road material is analyzed and materials to be added to the crushed road material are determined in amounts necessary to obtain a composition of the road surface to be renewed, mineral materials of grain size and amount depending on the composition of the road surface to be renewed, as obtained by analysis of the crushed material, and binders premixed with water are added to the crushed material so that the premixed binders are added to the crushed road material in a suspension state, the crushed road material is blended with said mineral materials and said pre-mixed binders in suspension state to obtain a renewed road material; and said renewed road material as obtained is built into said road surface to form a new road surface, the apparatus comprising an automotive chassis; at least one motor-driven milling roller provided under said chassis for milling-off the road surface; means for providing said pre-mixed binders in the suspension state to said milling roller; a compacting unit; storage containers for individually storing said materials to be added to the crushed road material; dosing means for said mineral materials and for said materials to be added to the crushed road material, and for binder components; mixing means for the milled-off material; and said dosing means, some of said storage containers and said mixing means being provided on said chassis.

2. An apparatus according to claim 1, wherein said milling roller simultaneously operates as a mixing means for blending the crushed road material with said mineral materials and said pre-mixed binders in suspension state.

3. An apparatus according to claim 1, wherein for intimate blending of the milled-off material with added materials, said mixing means is provided behind the milling roller in a direction of travel of the apparatus.

4. An apparatus according to claim 1, wherein said dosing means are controlled depending on a composition of the road surface before repair, as determined by a computer analysis.

5. An apparatus according to claim 1, wherein said means for dosing the mineral materials include one of conveyor belts or worm conveyors.

6. An apparatus according to claim 5, wherein said dosing means include dosing pumps for dosing the binder components.

7. An apparatus according to claim 6, wherein a computer is provided to control said dosing pumps and said conveyor belts or worm conveyors.

8. An apparatus according to claim 1, wherein some other storage containers are positioned on a separate transportation vehicle and the contents of said other storage containers are delivered via conveyor means to said dosing means.

9. An apparatus according to claim 8, wherein said conveyor means of said transportation vehicle is coupled to said dosing means.

10. An apparatus according to claim 8, wherein said storage containers for storing said mineral components are disposed on said chassis of the apparatus and storage containers for materials including cement sludge, water and a bitumen emulsion are disposed on the transportation vehicle.

11. A process for the stabilization or repair of damaged roads, by a cold-recycling process performed by a recycling machine, wherein a damaged road surface is milled off and a material covering the road surface is crushed on the site and is built-in again, the process comprising the steps of:

milling off the damaged road surface over the whole width of a road lane at a depth up to about 40 centimeters and crushing the milled-off material;

analyzing a sample of the crushed road material and determining materials to be added thereto in amounts necessary to obtain a composition of the road surface to be renewed;

adding to the crushed road material, mineral materials of grain size and amount depending on the composition of the road surface to be renewed, as obtained by analysis of the crushed material in said analyzing step, and binders pre-mixed with water so that the binders are added at a point of milling to the crushed road material in a suspension state, blending the crushed road material with said mineral materials and said pre-mixed binders in suspension state on the recycling machine to obtain a renewed road material; and building-in said renewed road material as obtained in said blending step into said road surface to form a new road surface.

12. A process according to claim 11, wherein upon the new road surface a cover layer of a new road material is applied.

13. A process according to claim 11, wherein by the addition of mineral components unevennesses in length and width profile of the road surface are levelled.

* * * * *